US007648377B2

(12) United States Patent
Naito et al.

(10) Patent No.: US 7,648,377 B2
(45) Date of Patent: Jan. 19, 2010

(54) CONNECTOR HAVING CONNECTION DETECTING MEANS WHICH IS ELASTICALLY DEFORMABLE

(75) Inventors: Takeharu Naito, Tokyo (JP); Takaaki Kudo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/220,997

(22) Filed: Jul. 30, 2008

(65) Prior Publication Data

US 2009/0035973 A1 Feb. 5, 2009

(30) Foreign Application Priority Data

Jul. 31, 2007 (JP) ..... 2007-199967

(51) Int. Cl.
*H01R 29/00* (2006.01)

(52) U.S. Cl. ..... 439/188; 439/67; 439/492

(58) Field of Classification Search ..... 439/67, 439/77, 188, 492–499
See application file for complete search history.

(56) References Cited

U.S. PATENT DOCUMENTS 6,576,853 B2 6/2003 Motojima
6,719,577 B2 * 4/2004 Nogami ..... 439/188
2003/0049968 A1 * 3/2003 Nogami ..... 439/630
2006/0110950 A1 * 5/2006 Ikenaga et al. ..... 439/67
2007/0093122 A1 * 4/2007 Kudo et al. ..... 439/495
2009/0035973 A1 * 2/2009 Naito et al. ..... 439/188

FOREIGN PATENT DOCUMENTS

JP 05-094968 12/1993
JP 2002-175735 6/2002
JP 2006-100165 4/2006

OTHER PUBLICATIONS

Japanese Office Action dated May 20, 2009.

* cited by examiner

*Primary Examiner*—James Harvey
(74) *Attorney, Agent, or Firm*—Collard & Roe, P.C.

(57) ABSTRACT

In a connector to be connected to a connection object, a housing holds at least one contact to be contacted with the connection object and a switch for detecting whether the connection object is in a connected state or an unconnected state. The switch includes a first conductive member and a second conductive member. The first conductive member includes a first spring portion which is elastically deformable and extends in a first direction to have a free end, a conductive member abutting portion which is formed at the free end of the first spring portion and adapted to the abutted to the connection object in the connected state in a second direction perpendicular to the first direction, and a first contact point which is connected to the first spring portion. The second conductive member includes a second contact point faced to the first contact point in the second direction.

11 Claims, 4 Drawing Sheets

CONNECTOR HAVING CONNECTION DETECTING MEANS WHICH IS ELASTICALLY DEFORMABLE

This application is based upon and claims the benefit of priority from Japanese patent application No. 2007-199967, filed on Jul. 31, 2007, the disclosure of which is incorporated herein in its entirety by reference.

TECHNICAL FIELD

This invention relates to a connector capable of electrically detecting a connected state of a connection object.

BACKGROUND ART

Proposal has been made of a connector comprising a contact for obtaining electrical connection with a connection object and connection detecting means for detecting a connected state of the connection object. The connection detecting means generally uses a conductive component having a shape same as or similar to that of the contact. When the connection object is normally connected to the connector, the connection object operates the conductive component so that the connected state of the connection object is electrically detected. Accordingly, in case where the connection object is made of a relatively hard material, for example, in case where the connection object is a typical printed board or a typical IC package, it is relatively easy to detect the connected state of the connection object by the use of the connection detecting means of the type described.

SUMMARY OF THE INVENTION

However, in case where the connection object is made of a relatively soft material, for example, in case where the connection object is a flexible cable or a flexible board, it is difficult to detect the connected state of the connection object by the use of the connection detecting means using the conductive component having a shape same as or similar to that of the contact. This is because the connection object made of a relatively soft material is not suitable to operate the conductive component having a shape same as or similar to that of the contact. It is noted here that the connection object and the contact can be brought into contact with each other by operating a special operating member.

Under the above-mentioned circumstances, it is proposed to detect the connected state of the connection object, for example, by a visual sense of an operator in case where the connection object is made of a relatively soft material (see JP-U-H05-94968). In this approach, however, there is a problem with detection accuracy because the visual sense of the operator is relied upon.

It is also proposed to perform detection by a tactile sense (JP-A-2006-100165). However, in this technique also, there is a problem with detection accuracy because the tactile sense of the operator is relied upon.

It is therefore an exemplary object of this invention to provide a connector capable of reliably and easily carrying out electrically detection of a connected state of a connection object.

Other objects of the present invention will become clear as the description proceeds.

According to an exemplary aspect of the present invention, there is provided a connector to be connected to a connection object, the connector comprising at least one contact to be contacted with the connection object, a switch for detecting whether the connection object is in a connected state or an unconnected state, and a housing which holds the at least one contact and the switch, wherein the switch includes a first conductive member and a second conductive member, the first conductive member includes a first spring portion which is elastically deformable and extends in a first direction to have a free end, a conductive member abutting portion which is formed at the free end of the first spring portion and adapted to the abutted to the connection object in the connected state in a second direction perpendicular to the first direction, and a first contact point which is connected to the first spring portion, and the second conductive member includes a second contact point faced to the first contact point in the second direction.

DESCRIPTION OF THE EXEMPLARY EMBODIMENT

Figure 1:
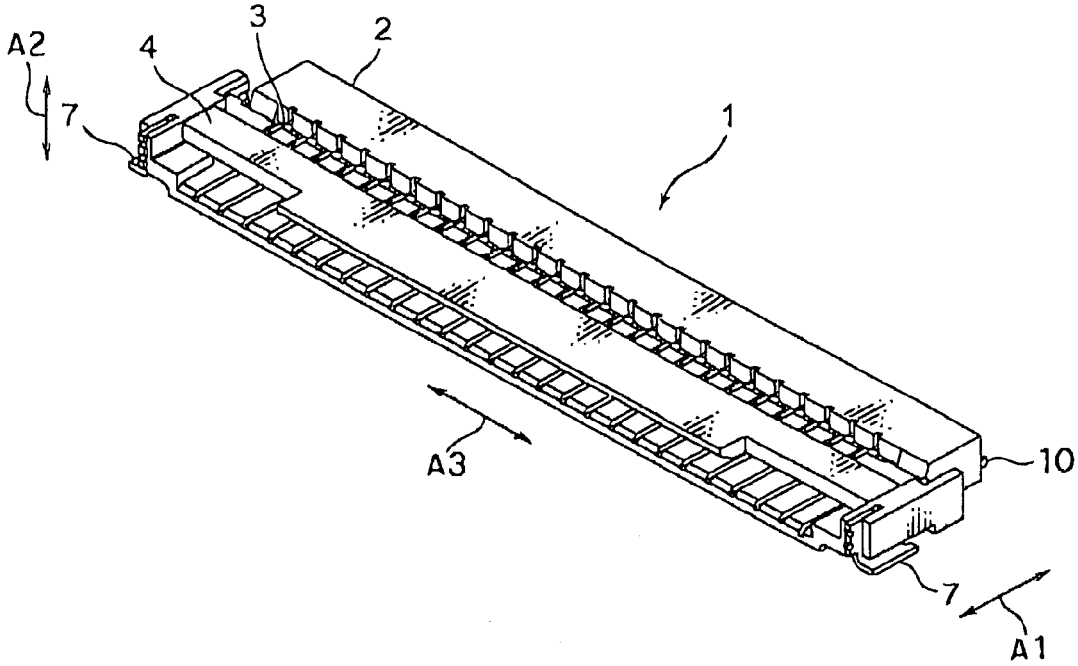
FIG. 1 is a perspective view of a connector according to an exemplary embodiment of this invention when an actuator is closed.
Figure 2:
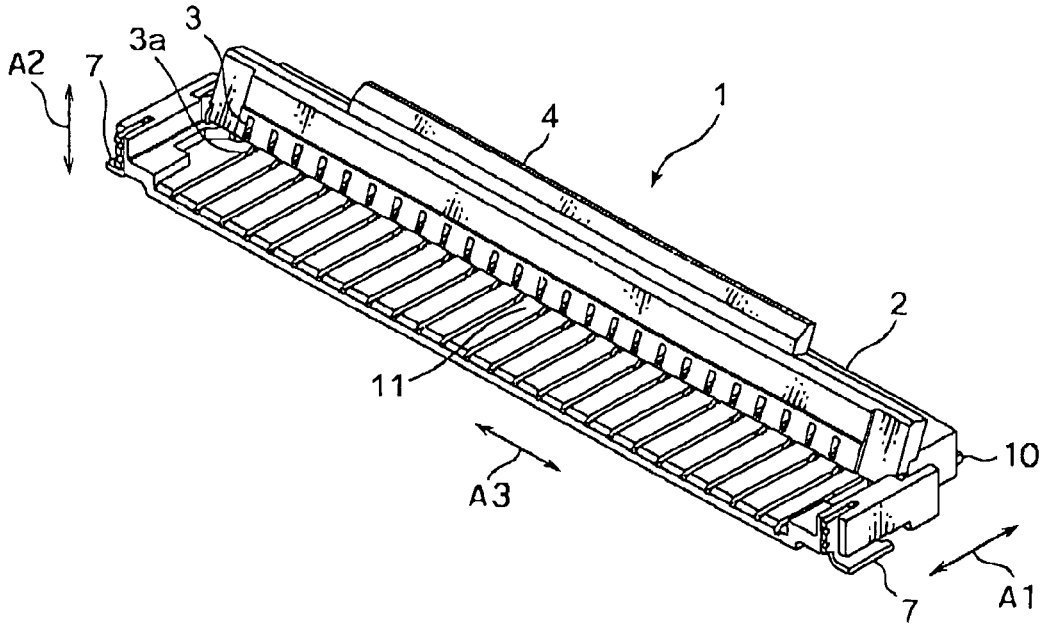
FIG. 2 is a perspective view of the connector in FIG. 1 when the actuator is opened.

Referring to FIGS. 1 and 2, description will be made of a connector according to an exemplary embodiment of this invention.

The connector illustrated in FIG. 1 is depicted by a reference numeral 1 and comprises an elongated housing 2 made of an insulating material. Herein, a width direction A1, a thickness direction A2, and a longitudinal direction A3 of the housing 2 will be called a first direction, a second direction, and a third direction, respectively.

The housing 2 holds a number of conductive contacts 3 arranged in a single row and in parallel to one another in the third direction A3 at a predetermined pitch. The housing 2 is provided with an actuator 4 made of an insulating material. The actuator 4 is mounted to the housing 2 so as to be rotatable with respect to an axis extending in the third direction A3. Furthermore, the housing 2 is provided with a pair of stiffeners 7 which are mounted to opposite sides thereof in the third direction A3, respectively, and which are adapted to be soldered to a mounting board (not shown) as a mounting object.

The connector 1 has an opening 11 defined by the housing 2. When the actuator 4 is opened as illustrated in FIG. 2, a flexible board as a connection object depicted by a reference numeral 21 in FIGS. 7 and 8 can be inserted into the opening 11 of the connector 1. In the opening 11, a plurality of contacting portions 3*a* of the contacts 3 are arranged in parallel to one another. When the actuator 4 is closed as shown in FIG. 1 after the flexible board is inserted into the opening 11, the actuator 4 brings the flexible board into press contact with the contacting portions 3*a* of the contacts 3. Thus, the flexible board 21 is connected to the connector 1.

The connector 1 further comprises a switch 10 as connection detecting means for detecting whether the flexible board 21 is in a connected state or an unconnected state. The switch 10 is held at one end of the housing 2 in the third direction A3 to be adjacent to the opening 11 as will later be described. The switch 10 is used to electrically detect an insertion state of the flexible board when it is inserted into the connector 1, i.e., to electrically detect whether or not the flexible board is properly inserted into the connector 1.

Figure 3:
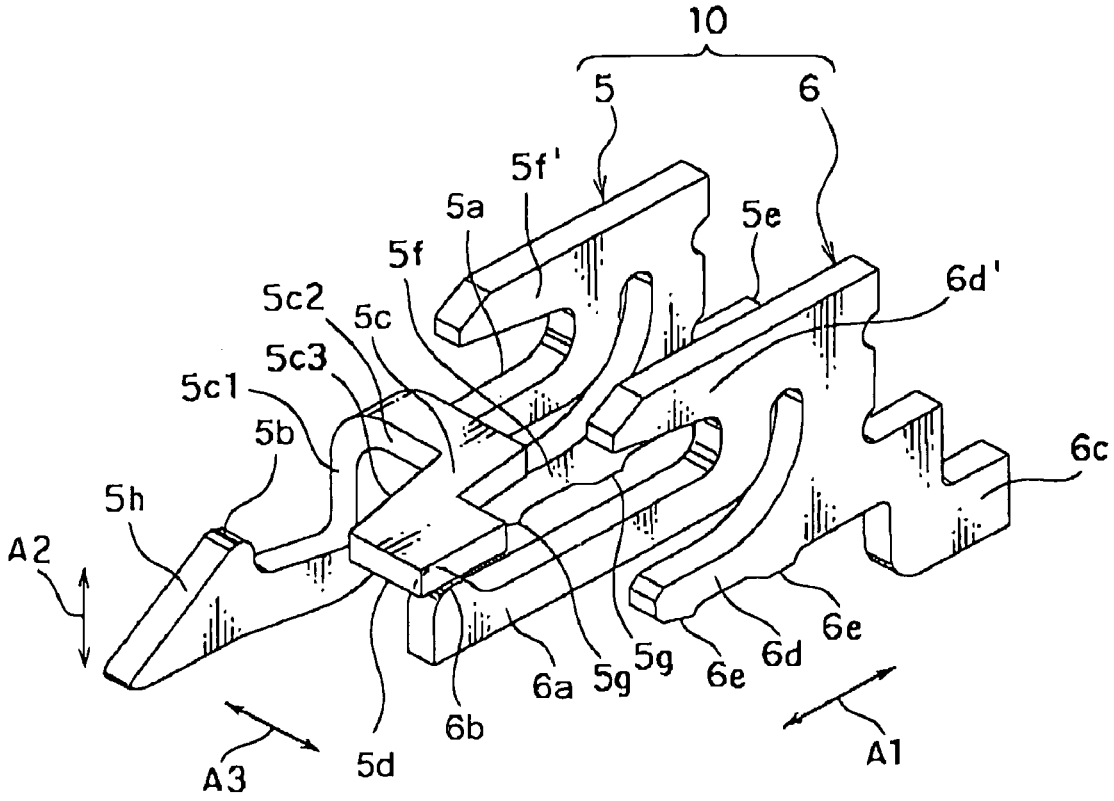
FIG. 3 is an enlarged perspective view of a switch of the connector illustrated in FIGS. 1 and 2.
Figure 4:
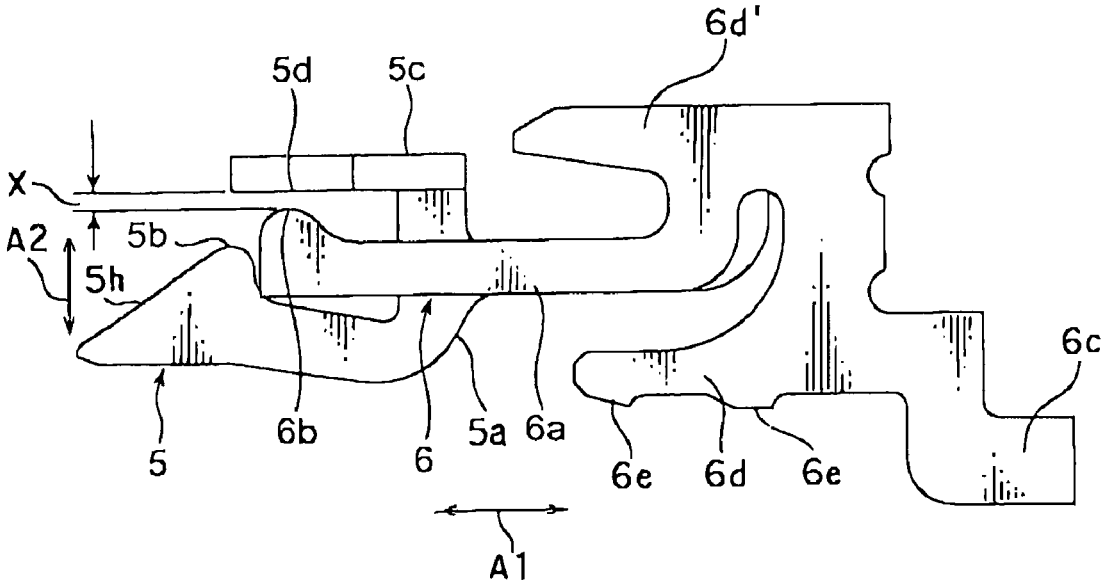
FIG. 4 is an enlarged side view of the switch illustrated in FIG. 3.

Referring to FIGS. 3 and 4 in addition, the switch 10 will be described.

The switch 10 comprises a first conductive piece or member 5 and a second conductive piece or member 6 adjacent to and in parallel to each other in the third direction A3. Each of the first and the second conductive members 5 and 6 is made of a metal material.

The first conductive member 5 includes a first spring portion 5*a* having a free end at one end and elastically deformable an abutting portion 5*b* formed adjacent to the free end of the first spring portion 5*a*, a connecting portion 5*c* extending from the first spring portion 5*a*, and a first contact point 5*d* formed on the connecting portion 5*c*. The abutting portion 5*b* is formed as a protrusion protruding from the first spring portion 5*a* in the second direction A2.

In order to obtain an excellent spring characteristic, the connecting portion 5*c* has a shape as a combination of two generally L-shaped portions. More in detail, the connecting portion 5*c* includes a first part 5*c*1 which extends from an intermediate position of the first spring portion 5*a* that is away from the free end of the first spring portion 5*a* and which extends in the second direction A2, a second part 5*c*2 bent from the first part 5*c*1 in the third direction A3 towards the second conductive member 6, and a third part 5*c*3 further bent from the second part 5*c*2 in the first direction A1 and connected to the first contact point 5*d*. The first contact point 5*d* has a plate-like shape widened in the first and the third directions A1 and A3.

The first conductive member 5 further has a first terminal portion 5*e* to be soldered to the mounting board and a pair of press-fit portions 5*f* and 5*f*' to be press-fitted to the housing 2. The first terminal portion 5*e* and the press-fit portions 5*f* and 5*f*' are integrally formed with the other end of the first spring portion 5*a*. Even in a state where the press-fit portions 5*f* and 5*f*' are press-fitted into the housing 2, the first spring portion 5*a* is elastically deformable. Therefore, the abutting portion 5*b* is movable at least in the second direction A2.

The second conductive member 6 includes a second spring portion 6*a* having a free end at one end and elastically deformable, a second contact point 6*b* formed adjacent to the free end of the second spring portion 6*a*, a second terminal portion 6*c* to be soldered to the mounting board, and a pair of press-fit portions 6*d* and 6*d*' to be press-fitted into the housing 2. The second terminal portion 6*c* and the press-fit portions 6*d* and 6*d*' are integrally formed with the other end of the second spring portion 6*a*. The second contact point 6*b* is formed as a protrusion protruding from the second spring portion 6*a* in the second direction A2. In detail, the second contact point 6*b* of the second conductive member 6 protrudes in a direction same as that of the abutting portion 5*b* of the first conductive member 5 and is faced to the first contact point 5*d* of the first conductive member 5 with a gap X left therebetween.

The press-fit portions 5*f* and 5*f*' are generally identical in shape with the press-fit portions 6*d* and 6*d*'. The press-fit portions 5*f* and 6*d* are provided with press-fit projections 5*g* and 6*e* which are engaged with a holding portion of the housing 2 so that the both of the first and the second conductive members 5 and 6 are securely held by the housing 2. The first spring portion 5*a* is provided with a slant surface 5*h* formed between the abutting portion 5*b* and the free end and adapted to be contacted with the flexible board 21 inserted through the opening 11. The first and the second terminal portions 5*e* and 6*c* are soldered and connected to an electric circuit of the mounting board.

Figure 5:
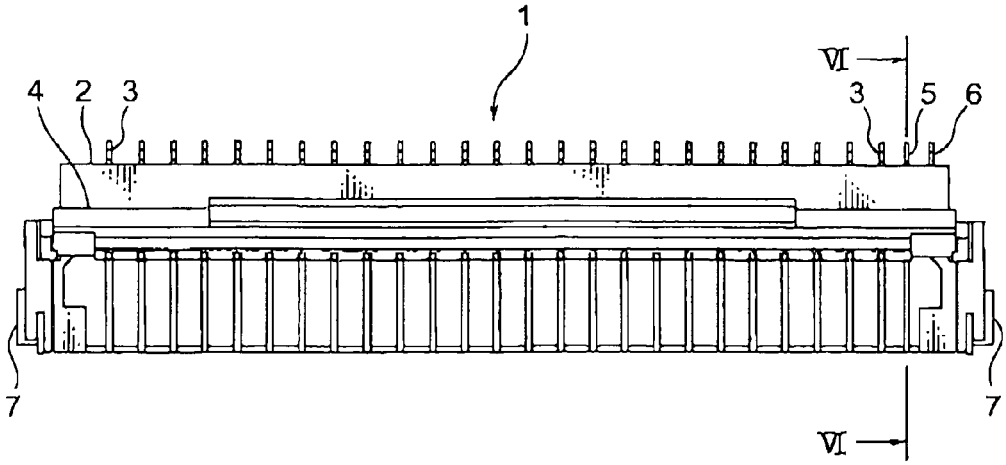
FIG. 5 is a plan view of the connector in FIG. 1 when the actuator is opened.
Figure 6:
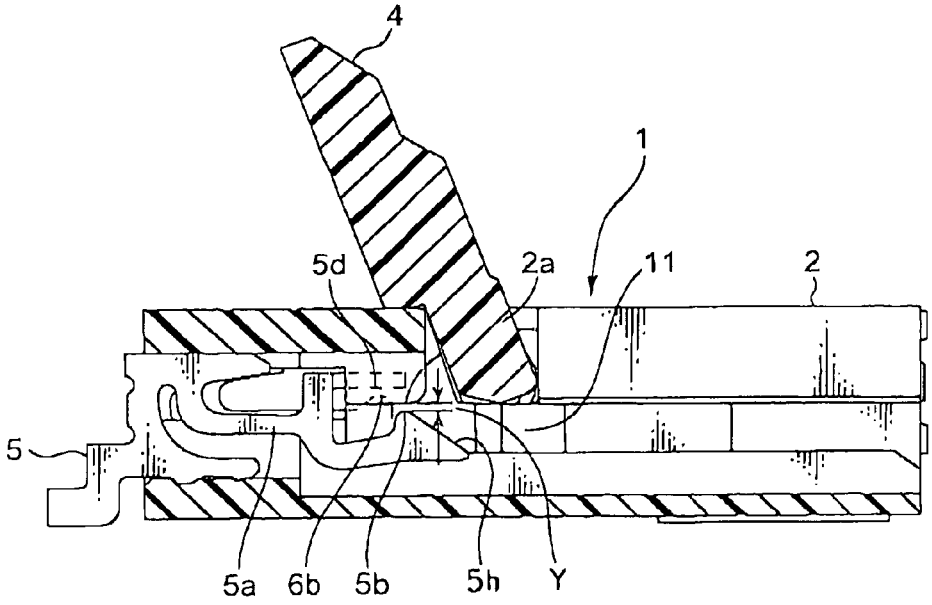
FIG. 6 is an enlarged sectional view taken along a line VI-VI in FIG. 5.
Figure 7:
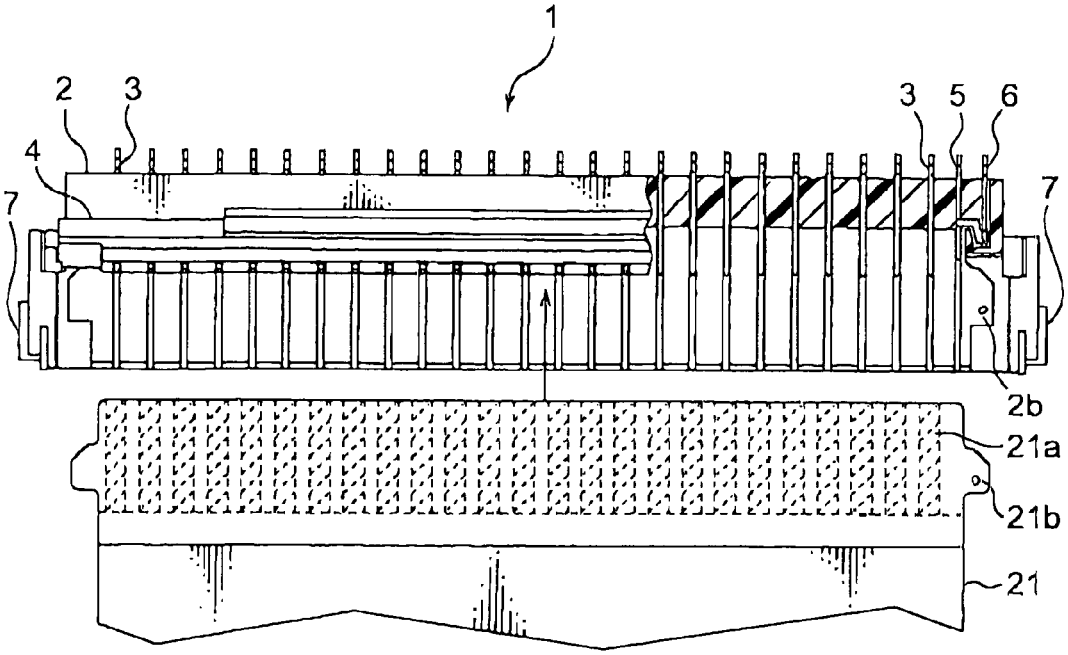
FIG. 7 is a partially-removed enlarged plan view showing the connector in FIG. 1 together with a connection object.

Referring to FIGS. 5 to 7 in addition, description will proceed further.

In FIGS. 5 and 6, the flexible board 21 is not yet inserted into the opening 11 of the housing 2. A gap Y between a housing abutting portion 2*a* of the housing 2 and the abutting portion 5*b* of the first conductive member 5 is slightly smaller than the thickness of the flexible board 21. In this state, the first contact point 5*d* of the first conductive member 5 is separated from the second contact point 6*b* of the second conductive member 6. Therefore, the first and the second conductive members 5 and 6 are electrically disconnected from each other.

Referring to FIG. 7, the connector 1 is illustrated with a part cutaway so that the interior is seen. The flexible board 21 as the connection object has a rear surface on which a number of conductors 21*a* are arranged in a single row at a predetermined pitch. The contacts 3 of the connector 1 are disposed at positions corresponding to the conductors 21*a*, respectively. The first conductive member 5 of the connector 1 is disposed at a position deviated from the conductors 21*a* of the flexible board 21.

Figure 8:
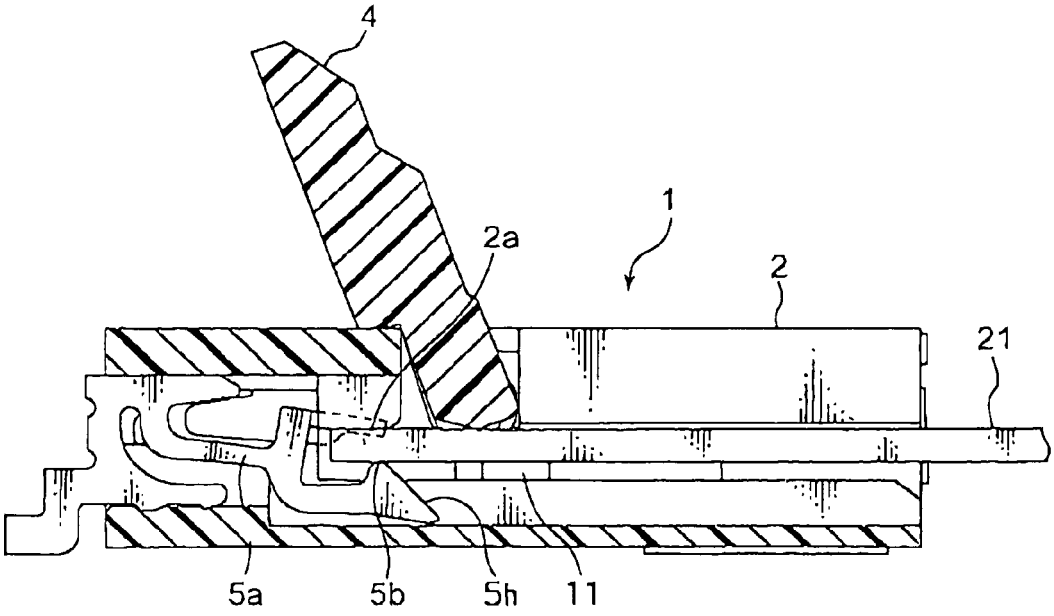
FIG. 8 is an enlarged sectional view similar to FIG. 6 and in the state illustrated in FIG. 7.

When the flexible board 21 is inserted into the connector 1, the flexible board 21 passes through the opening 11 of the housing 2 to be abutted to the slant surface 5*h* of the first spring portion 5*a*. When the flexible board 21 is further inserted inward as illustrated in FIG. 8, the flexible board 21 presses the slant surface 5*h* to elastically deform the first spring portion 5*a* and advances into an area between the housing abutting portion 2*a* of the housing 2 and the abutting portion 5*b* of the second conductive member 5 to widen the gap Y to the thickness of the flexible board 21. Due to the elastic deformation of the first spring portion 5*a* at this time, the first contact point 5*d* is moved over a distance greater than the gap X. As a consequence, the first contact point 5*d* of the first conductive member 5 moves downward to be brought into press contact with the second contact point 6*b* of the second conductive member 6. Accordingly, the first and the second conductive members 5 and 6 are electrically connected to each other.

The fact that the first and the second conductive members 5 and 6 are electrically connected to each other may be informed to an operator by light emission of a lamp or a ringing sound of a buzzer which is disposed at an appropriate position of the mounting board or the connector 1.

In order to prevent the flexible board 21 from being undesirably removed from the connector 1, the housing 2 is provided with a stopper recess 2*b* while the flexible board 21 is provided with a stopper protrusion 21*b*. When the flexible board 21 is completely inserted into the housing 2 of the connector 1 and the actuator 4 is rotated to connect the flexible board 21 to the connector 1, the stopper recess 2*b* and the stopper protrusion 21*b* are engaged with each other to prevent the flexible board 21 from being removed.

With the above-mentioned connector 1, various exemplary advantages will be expected as enumerated below.

1. When the connection object is properly inserted into the connector 1, the first and the second conductive members 5 and 6 are electrically connected to each other. It is therefore possible to reliably detect whether or not the flexible board 21 is properly inserted.

2. The first and the second conductive members 5 and 6 are connected with elastic deformation of the spring portions 5*a* and 6*a*. Therefore, even if the connection object is made of a relatively soft material, for example, even if the connection object is flexible, a stable and reliable operation is achieved.

3. The housing 2 only requires a working step of forming the housing abutting portion 2*a* to be abutted to the connection object when it is inserted. Therefore, required modification is very little.

4. The first spring portion 5*a* has a plurality of L-shaped portions. Therefore, an excellent spring characteristic is obtained and the connector 1 has a space-saving structure.

5. The switch 10 comprises the first and the second conductive members 5 and 6. Thus, the connector 1 can be made to have a simple structure.

Next, various exemplary embodiments of this invention will be enumerated in the following items 1-12.

1. A connector to be connected to a connection object 21, the connector comprising:

at least one contact 3 to be contacted with the connection object 21;

a switch 10 for detecting whether the connection object 21 is in a connected state or an unconnected state; and a housing 2 which holds the at least one contact 3 and the switch 10;

wherein the switch 10 includes a first conductive member 5 and a second conductive member 6;

the first conductive member 5 includes:

a first spring portion 5*a* which is elastically deformable and extends in a first direction A1 to have a free end;

a conductive member abutting portion 5*b* which is formed at the free end of the first spring portion and adapted to the abutted to the connection object 21 in the connected state in a second direction A2 perpendicular to the first direction A1; and a first contact point 5*d* which is connected to the first spring portion 5*a;* and the second conductive member 6 includes a second contact point 6*b* faced to the first contact point 5*d* in the second direction A2.

2. The connector according to item 1, wherein the first and the second conductive members 5 and 6 are disposed adjacent to each other in a third direction A3 perpendicular to the first and the second directions A1 and A2.

3. The connector according to item 1, wherein the second conductive member 6 further comprise a second spring portion 6*a* which is elastically deformable and extends in the first direction A1 to have a free end, and the second contact point 6*b* is formed at the free end of the second spring portion 6*a*.

4. The connector according to item 3, wherein the first and the second contact points 5*d* and 6*b* are deviated in position from each other in the first direction A1.

5. The connector according to item 1, wherein the housing 2 comprises a housing abutting portion 2*a* which is faced to the conductor abutting portion 5*b* in the second direction A2, and the connection object 21 is inserted into an area between the housing abutting portion 2*a* and the conductor abutting portion 5*b* in the connected state.

6. The connector according to item 5, wherein the relationship between the conductor abutting portion 5*b* and the housing abutting portion 2*a* is determined so that, in the connected state, the first spring portion 5*a* is pressed by the connection object 21 to be elastically deformed.

7. The connector according to item 5, wherein the housing 2 has an opening 11 for receiving the connection object 21 to be inserted therein in the first direction A1.

8. The connector according to item 1, wherein the housing 2 has an opening 11 for receiving the connection object 21 to be inserted therein in the first direction A1, and the switch 10 is disposed at a position corresponding to one end of the opening 11 in a third direction A3 perpendicular to the first and the second directions A1 and A2.

9. The connector according to item 8, wherein the at least one contact 3 is disposed at a position corresponding to an intermediate position of the opening 11 in the third direction A3.

10. The connector according to item 1, wherein the first conductive member 5 further comprises a connecting portion 5*c* connecting the first contact point 5*d* to the first spring portion 5*a*, and the connecting portion 5*c* comprises at least one substantially L-shaped portion.

11. The connector according to item 1, wherein the first spring portion 5 comprises an intermediate portion which is away from the free end thereof, the first conductive member 5 further includes a connecting portion 5*c* connecting the first contact point 5*d* to the first spring portion 5*a*, the connecting portion 5*c* comprises:

a first part 5*c*1 which extends from the intermediate portion in the second direction A2; and a second part 5*c*2 which is bent from the first part in a third direction A3 perpendicular to the first and the second directions A2 and A3.

12. The connector according to item 11, wherein the connecting portion 5*c* includes a third part bent 5*c*3 from the second part 5*c*2 in the first direction A1 and connected to the first contact point 5*d*.

While the present invention has thus far been described in connection with the exemplary embodiment thereof, it will readily be possible for those skilled in the art to put this invention into practice in various other manners. In the above-mentioned connector, the switch is mounted to only one side of the housing in the third direction. Alternatively, a pair of the switches may be mounted to the opposite sides of the housing, respectively. The first spring portion may have only one L-shaped portion. Instead of the flexible board, the flexible cable can be connected to the connector.

What is claimed is:

1. A connector to be connected to a connection object, the connector comprising:

at least one contact to be contacted with the connection object;

a switch for detecting whether the connection object is in a connected state or an unconnected state; and a housing which holds the at least one contact and the switch;

wherein the switch includes a first conductive member and a second conductive member;

the first conductive member includes:

a first spring portion which is elastically deformable and extends in a first direction to have a free end;

a conductive member abutting portion which is formed at the free end of the first spring portion and adapted to the abutted to the connection object in the connected state in a second direction perpendicular to the first direction; and a first contact point which is connected to the first spring portion; and the second conductive member includes a second contact point faced to the first contact point in the second direction; and wherein the first and the second conductive members are disposed adjacent to each other in a third direction perpendicular to the first and the second directions.

2. A connector to be connected to a connection object, the connector comprising:

at least one contact to be contacted with the connection object;

a switch for detecting whether the connection object is in a connected state or an unconnected state; and a housing which holds the at least one contact and the switch;

wherein the switch includes a first conductive member and a second conductive member;

the first conductive member includes:

a first spring portion which is elastically deformable and extends in a first direction to have a free end;

a conductive member abutting portion which is formed at the free end of the first spring portion and adapted to the abutted to the connection object in the connected state in a second direction perpendicular to the first direction; and a first contact point which is connected to the first spring portion; and the second conductive member includes a second contact point faced to the first contact point in the second direction; and wherein the first spring portion comprises an intermediate portion which is away from the free end thereof, the first conductive member further includes a connecting portion connecting the first contact point to the first spring portion, the connecting portion comprises:

a first part which extends from the intermediate portion in the second direction; and a second part which is bent from the first part in a third direction perpendicular to the first and the second directions.

3. The connector according to claim 1, wherein the second conductive member further comprises a second spring portion which is elastically deformable and extends in the first direction to have a free end, and the second contact point is formed at the free end of the second spring portion.

4. A connector to be connected to a connection object, the connector comprising:

at least one contact to be contacted with the connection object;

a switch for detecting whether the connection object is in a connected state or an unconnected state; and a housing which holds the at least one contact and the switch;

wherein the switch includes a first conductive member and a second conductive member;

the first conductive member includes:

a first spring portion which is elastically deformable and extends in a first direction to have a free end;

a conductive member abutting portion which is formed at the free end of the first spring portion and adapted to the abutted to the connection object in the connected state in a second direction perpendicular to the first direction; and a first contact point which is connected to the first spring portion; and the second conductive member includes a second contact point faced to the first contact point in the second direction and a second spring portion which is elastically deformable and extends in the first direction to have a free end, the second contact point being formed at the free end of the second spring portion; and wherein the first and the second contact points are deviated in position from each other in the first direction.

5. The connector according to claim 1, wherein the housing comprises a housing abutting portion which is faced to the conductive member abutting portion in the second direction, and the connection object is inserted into an area between the housing abutting portion and the conductive member abutting portion in the connected state.

6. The connector according to claim 5, wherein the relationship between the conductive member abutting portion and the housing abutting portion is determined so that, in the connected state, the first spring portion is pressed by the connection object to be elastically deformed.

7. The connector according to claim 5, wherein the housing has an opening for receiving the connection object to be inserted therein in the first direction.

8. A connector to be connected to a connection object, the connector comprising:

at least one contact to be contacted with the connection object;

a switch for detecting whether the connection object is in a connected state or an unconnected state; and a housing which holds the at least one contact and the switch;

wherein the switch includes a first conductive member and a second conductive member;

the first conductive member includes:

a first spring portion which is elastically deformable and extends in a first direction to have a free end;

a conductive member abutting portion which is formed at the free end of the first spring portion and adapted to the abutted to the connection object in the connected state in a second direction perpendicular to the first direction; and a first contact point which is connected to the first spring portion; and the second conductive member includes a second contact point faced to the first contact point in the second direction; and wherein the housing has an opening for receiving the connection object to be inserted therein in the first direction, and the switch is disposed at a position corresponding to one end of the opening in a third direction perpendicular to the first and the second directions.

9. The connector according to claim 8, wherein the at least one contact is disposed at a position corresponding to an intermediate position of the opening in the third direction.

10. The connector according to claim 1, wherein the first conductive member further comprises a connecting portion connecting the first contact point to the first spring portion, and the connecting portion comprises at least one substantially L-shaped portion.

11. The connector according to claim 2, wherein the connecting portion includes a third part bent from the second part in the first direction and connected to the first contact point.

* * * * *